United States Patent [19]

Langford

[11] Patent Number: 5,020,465

[45] Date of Patent: Jun. 4, 1991

[54] COUPLEABLE FLOTATION APPARATUS FORMING LINES AND ARRAYS

[76] Inventor: Frederick Langford, 212 Crest Rd., Cape May Court House, N.J. 08210

[21] Appl. No.: 437,445

[22] Filed: Nov. 15, 1989

[51] Int. Cl.[5] ..... B63B 7/00

[52] U.S. Cl. ..... 114/345; 24/618; 403/70; 441/129

[58] Field of Search ..... 114/345, 346, 352, 354, 114/249; 441/35, 40, 41, 65, 66, 73, 129–132, 136; 24/614, 618, 662; 403/69, 70

[56] References Cited

U.S. PATENT DOCUMENTS

| | | | |
|---|---|---|---|
| 2,895,199 | 7/1959 | Jones | 24/618 |
| 3,614,815 | 10/1971 | Nysten | 24/662 |
| 3,696,451 | 10/1972 | Thompson | 114/345 |
| 4,373,826 | 2/1983 | Inamoto et al. | 24/618 X |
| 4,894,033 | 1/1990 | Chang | 441/130 X |

FOREIGN PATENT DOCUMENTS

| | | | |
|---|---|---|---|
| 2609480 | 9/1977 | Fed. Rep. of Germany | 114/345 |
| 2108435 | 5/1983 | United Kingdom | 441/130 |

*Primary Examiner*—Ed Swinehart
*Attorney, Agent, or Firm*—Eckert Seamans Cherin & Mellott

[57] ABSTRACT

A flotation apparatus such as an inflatable tube is designed for a wide sluice waterslide. A coupling for the tube has a prong on the bow of the tube, which is V-shaped, the prong extending forward along a handle portion and downward to a distal locking knob with radial fins. A positioning plate reinforces the coupling between the prong and a mounting plate on the tube. A coupling ring is attached to the mounting plate or the positioning plate, laterally of the prong, and a second coupling ring is provided at the stern of the tube, such that the tube can be coupled to other such tubes in single file or face to face arrays. The fins of the prong and the inside diameter of the rings are complementarily conical in the insertion and removal directions. A wide sluice waterslide to be traversed by the tubes as joined in lines or arrays has a generally downhill contour along a sinuous path. However, the downhill contour is limited to the inside of the curves, and along the centerline of the path as well as along the banked outsides of the curves, the path proceeds uphill as well as generally downward and around curves. Along the uphill stretches, supplementary water inlets are provided, supplying a lateral flow over which the tubes can pass.

26 Claims, 4 Drawing Sheets

FIG 1
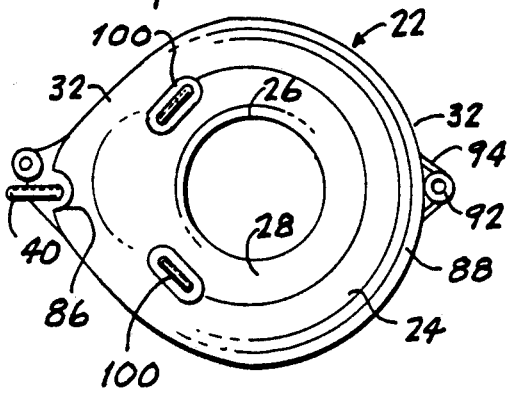
FIG 2
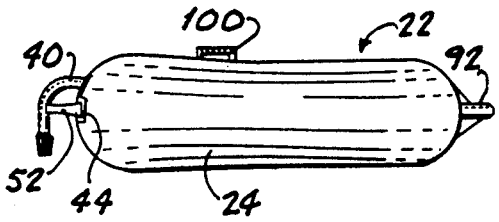
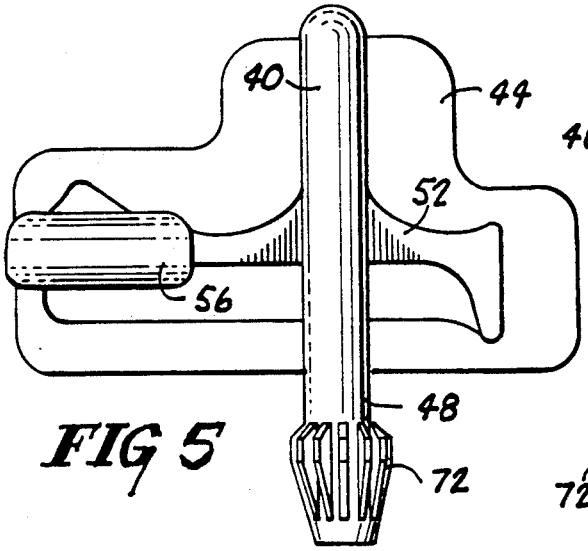
FIG 5
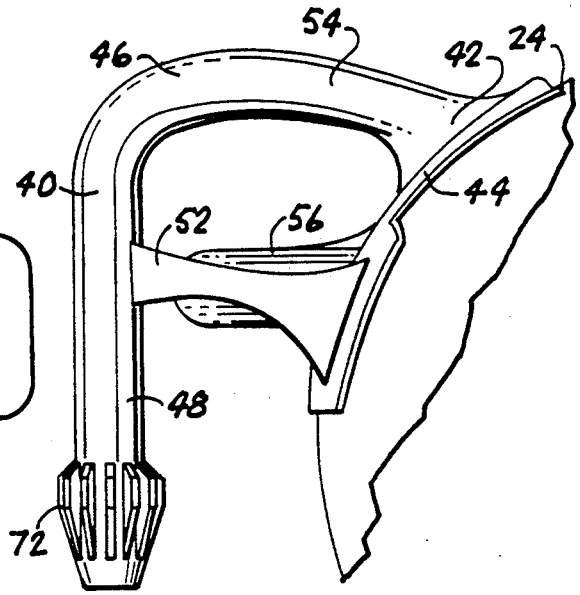
FIG 3
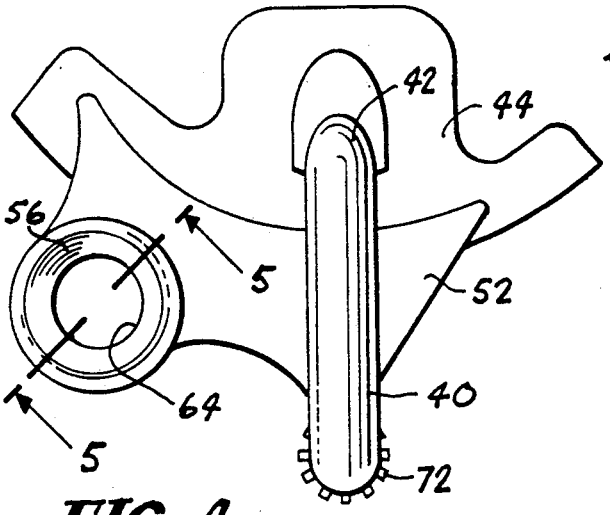
FIG 4
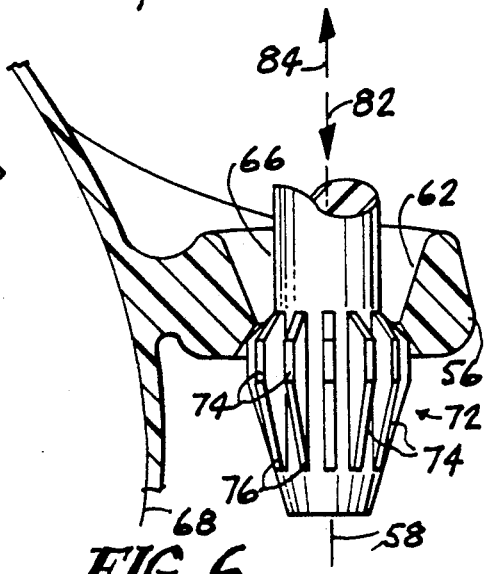
FIG 6

COUPLEABLE FLOTATION APPARATUS FORMING LINES AND ARRAYS

BACKGROUND OF THE INVENTION

1. Field of the Invention

This invention relates to the field of waterslides traversed by buoyant bodies. The invention concerns an improved one person inflatable flotation tube with a coupling enabling the tubes to be joined into lines and arrays for use in water sports and on waterslides, and an improved waterslide having a sluice width substantially in excess of the width of buoyant bodies traversing the waterslide. The sluice has uphill banked turns fed by supplemental water supplies, which turns are traversed by said flotation bodies as well as by lines and arrays of flotation bodies.

2. Prior Art

A waterslide typically involves a path with an elongated trough or sluice through which water flows, the trough defining a continuously downward flow path. The waterslide riders float down the waterslide on a shallow stream of water which flows continuously downhill in the trough at the same velocity as the riders. The flow of water is controlled by the contour of the sluice, with a predetermined amount of water flowing into the sluice at the top, or perhaps at the top of a particular downhill run along the sluice. The sluices or waterslides can lead to intermediate pools, and outlets from the intermediate pools lead to further slides, etc. The sluice typically defines a sinuous path, and the curves are correspondingly banked such that the flow of water due to inertia is not restricted to the lowest cross-sectional portion of the sluice, but rather rises somewhat along the sides of the sluice. Accordingly, in traversing turns the riders become canted to an angle defined by the surface of the water flowing around the turn. The water which flows into the sluice at the top traverses the sluice and exits at the bottom, a pump frequently being used to recycle the water from the bottom pool to the starting or top pool.

The flow of water along a waterslide sluice is to some extent similar to the flow of water employed on sliding boards used at swimming pools. In the typical swimming pool sliding board, a traditional sliding board is supplemented by a thin film of water flowing onto the slide at the top from a line of inlets spaced across the width of the sliding board. This water prevents friction between the wet swimming suit of the slider and the surface of the sliding board. The water flows directly down the slide in the same direction as the slider. Waterslides are similar in that water flows along with the rider, however the flow is typically deeper, whereby the rider can float on the current using a flotation device.

Waterslide riders can traverse the slides with or without flotation devices, however flotation devices are preferred due to their ability to protect the rider from friction with the sluice and to support the rider in the relatively deeper water as compared to water used to wet a sliding board. Whether a particular waterslide sluice is arranged for persons or flotation devices is usually a matter of the width of the sluice and the flow of water.

The sluice width is arranged such that the rider or the rider's flotation apparatus is guided between the sidewalls. The rider or flotation device cannot easily turn laterally to the flow and either block traffic or subject the rider to friction along the sluice sides above the water level and/or a strong flow of water passing by.

Air mattresses have often been used for flotation in waterslide parks. However, an air mattress is not a stable or comfortable support for a rider traversing a sinuous path. The rider must lie prone on an air mattress, face up or face down. The prone rider cannot see the upcoming portions of the track as well as a sitting rider, which detracts from the excitement of the ride. There is also a danger of collision with other riders, particularly because the rider may allow his or her head to protrude over the forward end of the air mattress.

Tubular flotation devices are well known for water sports. The inner tubes of vehicle tires are often used for flotation in swimming pools and lakes and are sometimes pulled behind boats. Such tubes can be used to traverse the sluices of waterslide parks. Tubes are convenient flotation devices because a person can sit comfortably upright in the central opening defined by the tube, with the user's legs hanging over the sides. Durable versions of the tubes have been developed to resist damage from friction, for example the friction occurring between the tube and the sides of waterslide sluices. Such tubes, for example are made of resin embedded in a fiber as the wear-resistant external skin of an inflatable tube. Such tubes are also known with handles on the top surface, to be engaged by the rider when sitting in an upright position. Due to these beneficial attributes, tubes have become a preferred form of flotation device for waterslide parks wherein the riders traverse a sluice on an individual flotation device.

Riders of waterslides frequently attend in groups. Members of the group are desirous of traversing the slide together. While traversing the sluice one after another is in a sense traversing the sluice together, riders also sometimes will join hands and traverse the slide single file. Of course when joining hands it is not possible to maintain a hold on any handles that may be provided on the rider's tube.

In order to serve the user's desires, park operators have designed a double tube or "double doughnut" wherein an inflatable body in a figure eight shape provides apertures for two riders to sit. As a result of the integral structure of such double capacity tubes, however, the device is relatively rigid along its longer dimension, causing added wear on the tube in traversing curves, and causing some problems in wider areas such as pools, should the large double tube be turned sideways to the major direction of water flow and traffic. The double tubes do not bend laterally to follow the sinuous path of the sluice to the same extent as individual tubes. Similarly, double tubes cannot bend easily through vertical digressions along the path, such as bumps and dishes.

These double tubes have been provided with handles in the same manner as single tubes and have also been provided with V-shaped leading bows or prows such that the tubes are somewhat like a boat with a tapering front and a blunt stern, being thereby more apt to proceed along the desired path, i.e., the longitudinal centerline of the waterflow. Nevertheless, the double tubes are large and unwieldy as compared to single tubes and thus leave something to be desired.

In order to avoid problems with blockage, wear and collisions, while maintaining the capability of carrying a plurality of riders, a means to allow an angular deflection between individual tubes is contemplated according to the present invention. To further maintain the ability to use the same apparatus for individual riders, the invention employs a coupling that is easily engaged and somewhat less easily disengaged. The coupling permits any number of tubes to be joined into a line, defining an articulation which can optionally fix two tubes in a line or provide freedom to flex in two mutually perpendicular directions. This is done with a vertically downwardly oriented prong member that engages with a corresponding ring of a next identical tube. By lifting the prong end of one tube to be connected, or pressing the ring end of a tube downwardly into the water, the rider can engage one tube with another to provide a composite multi-seat tube structure that easily traverses curves due to its articulation at the coupling. The articulation can be limited by including a coupling ring spaced laterally of the prong of each tube according to a further feature of the invention. The coupling part carrying the prong preferably also carries the ring, and a further ring is provided on each tube at an opposite end to achieve the alternative connection permitting flexing around the axis of the prong. In this manner, the one person tubes can be connected into a very flexible line, or alternatively connected into a substantially fixed array of any number of tubes by connecting the couplings of a plurality of tubes in facing relationship. A four tube array is facilitated by providing a V-shaped prow or bow to each of the tubes at the end of the tube having the prong and ring coupling elements.

In accordance with the invention, a waterslide of the known type can accommodate tubes in a linear array, and a waterslide which is substantially wider than an individual tube can accommodate arrays of any number of riders. Furthermore, single file connected tubes traversing the wider waterslide can follow rider-selected trajectories through turns. The invention thus opens numerous new possibilities for waterslides, while improving their performance, enjoyability and safety.

Inasmuch as the waterslide will accommodate arrays of tubes, the sluice width is made sightly more than twice the width of a tube. Tubes in a line will speed along with gravity as the rear portions of the line urge the front portion forward and are not limited to the velocity or path of the waterflow. The flow of water in the sluice follows the usual inertial flow pattern, with water rising on the outside wall of the sluice at curves. However, in addition to accommodating inertial variations in the vertical depth of water in the sluice, the invention includes extreme banking and uphill stretches along the sluice at the outside edges of curves downstream of downslopes, which the tubes or lines of tubes can follow along a trajectory of choice. A proficient rider coming to a curve after a downhill stretch thus has the ability to slide on the sluice walls at the high side of the curves and can clear the inertial water flow. To enable the riders to thereby skim along the uphill running outside walls of curves along the path, additional water is added to the flow at the uphill running outside walls. The added water is not subject to inertial forces as is the water proceeding directly down the sluice. The added water thus does not carry the rider along but instead provides a thin layer of low friction over which the rider can skim. With these improvements, the sluice permits a great number of opportunities for enjoyment and is substantially improved over the known waterslide sluice wherein the riders simply move along the waterflow path.

SUMMARY OF THE INVENTION

It is an object of the invention to improve known waterslides by providing a waterslide configuration and a flotation device whereby the riders have options for following trajectories down a wide and banking waterslide sluice.

It is also an object of the invention to improve the versatility of flotation equipment, especially tubular flotation devices, to enable easy and safe coupling of a plurality of the devices into flexible lines or two dimensional arrays.

It is another object of the invention to provide a coupling for inflatable tube flotation devices, articulated on mutually perpendicular axes, which is inexpensive, durable and easy to operate.

It is a further object of the invention to provide a coupling to join individual rider tubes in waterslides, which enables a line of tubes to follow a sinuous path and which is relatively secure against inadvertent disengagement.

It is a further object of the invention to provide an improved waterslide wherein a low friction water curtain covers the high outside wall of the sluice at curves whereby a high trajectory wholly or partly leaving the main waterflow and proceeding uphill can be selected by riders who skim over the curtain of water.

These and other objects are accomplished by an improved waterslide and a flotation apparatus therefor. The flotation apparatus includes an inflatable tube, designed for alternative trajectories along a wide sluice waterslide. A coupling for the tube has a prong on the bow of the tube, which is V-shaped, the prong extending forward along a handle portion and downward to a distal locking knob with radial fins. A positioning plate reinforces the coupling between the prong and a mounting plate on the tube. A coupling ring is attached to the mounting plate or the positioning plate, laterally of the prong, and a second coupling ring is provided at the stern of the tube, such that the tube can be coupled to other such tubes in single file or face to face arrays. The fins of the prong and the inside diameter of the rings are complementarily conical in the insertion and removal directions. The wide sluice waterslide to be traversed by the tubes as joined in lines or arrays has a generally downhill contour along a sinuous path. However, the requirement for a continuous downhill contour is limited to the insides of curves. Along the centerline of the path as well as along the banked outsides of the curves, the path proceeds uphill. Along the uphill stretches, supplementary water inlets are provided, supplying a lateral flow over which the tubes can pass.

BRIEF DESCRIPTION OF THE DRAWINGS

There are shown in the drawings the embodiments of the invention as presently preferred. It should be understood that the invention is capable of other embodiments and combinations of elements in accordance with the scope of the invention as claimed in the drawings:

FIG. 1 is a top plan view of a flotation apparatus according to the invention.

FIG. 2 is a side elevation view thereof.

FIG. 3 is a partial side elevation view showing the coupling at the bow of the flotation apparatus in detail.

FIG. 4 is a top plan view of the coupling of FIG. 3.

FIG. 5 is a front elevation of the coupling of FIG. 3.

FIG. 6 is a partial section view taken along lines 6—6 in either of FIGS. 4 and 9, with the prong portion of one flotation apparatus shown engaged with the ring portion of another flotation apparatus.

DETAILED DESCRIPTION OF THE PREFERRED EMBODIMENTS

Figure 7:
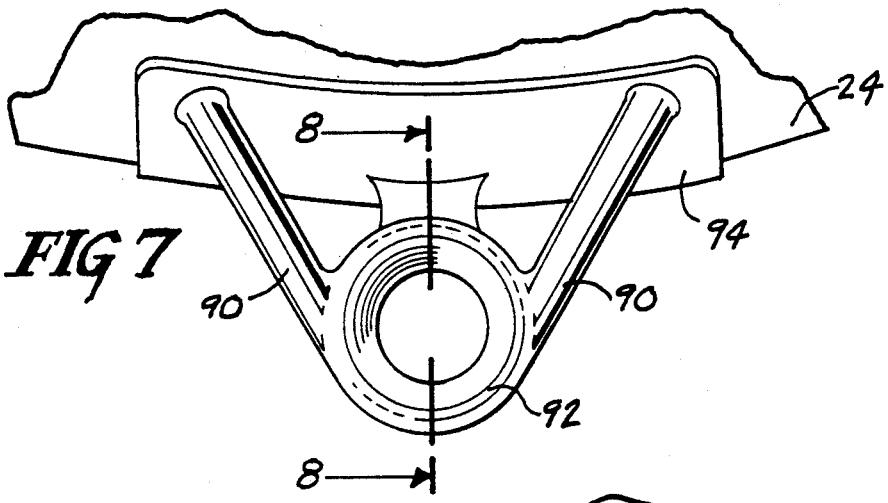
FIG. 7 is a top plan view of a stern coupling element according to the invention.

Referring to FIG. 1, the preferred flotation apparatus 22 according to the invention is generally similar to the well known inner tube, having a tubular buoyant body 24, defining a central aperture 26, which is about the right size for a rider to sit comfortably in the tube, with the rider's legs draped over the sides of the tube. Two handles 100 are provided on the upper surface of the flotation body, the rider's legs extending either between or outside the handles 100. The flotation apparatus can be of any buoyant material. However, it is preferred that the tube be made of an inflated skin of fiber with embedded resin. This material is known in the art, for example for air mattresses and tube flotation apparatus lacking the coupling features of the invention. While the invention is described with respect to inflatables, which are the preferred form of flotation device for waterslides and the like, it will be appreciated that other buoyant materials can also be used, for example foamed polyurethane with a wear resistant skin.

The handles 100 can be fixed to the outer wall 32 of the buoyant body 24, for example by adhesives or by resinous welding. Handles 100 are flexible plastic, for example polyvinyl chloride (PVC). The flotation body includes a front coupling element also made of flexible PVC. The coupling element is used to engage a plurality of the tubes into a single file line, a two dimensional array, or combinations of these configurations. This is accomplished by including at least one coupling element on an outer wall 32 of the buoyant body, which coupling element joins to a mating coupling element on other buoyant bodies of similar design.

Preferably, the buoyant body 24 is provided with couplings at the bow or front, which may be substantially V-shaped as shown, and also at the stern, which is more blunt shaped such that the buoyant body has a preferential direction of movement, i.e., wherein the less fluid-resistant V-shaped bow or prow leads. Accordingly, when the buoyant body is proceeding faster than the water flowing along the sluice of a waterslide or the like, the rider obtains certain control of the trajectory by steering the prow using the handles 100.

The bow coupling preferably includes both a male and female coupling element, the two being spaced laterally from one another. The stern coupling element can optionally also include two alternative laterally spaced coupling genders, but preferably has only a coupling ring 92, to which a bow coupling element can be engaged. With reference to FIGS. 2-5, the bow coupling has a coupling prong 40, attached by its proximal end 42 to the buoyant body 24. The prong can be attached by a mounting plate 44, adhesively attached or welded to the outer surface 32 of buoyant body 24 in the same manner as handles 100. The mounting plate has a curving configuration to follow the curving outer wall 32 of the buoyant body and to spread the stress of the coupling over an area of the outer wall.

The proximal end of the coupling prong 40 leads to a proximal section 46, preferably including an arched shape to provide a resilient bumper softening frontal impact of the coupling against a surface. In addition, the proximal section 46 of prong 40 provides a handle for manipulating the floatation apparatus 22 and for more easily effecting the engagement and disengagement of the coupling.

The leading or distal section 48 of coupling prong 40 turns downwardly to end at a distal knob 72, which is inserted in coupling ring 56 or 92 to engage the flotation apparatus with another flotation apparatus. In the bow coupling shown in FIGS. 2-5, the coupling ring 56 is shown midway along a vertical height of distal section 48 of coupling prong 40. At the same height, a positioning plate 52 extends between the mounting plate 44 and the coupling prong 40, and this positioning plate is also fixed to coupling ring 56. Accordingly, when the coupling prong 40 is engaged in a coupling ring 56 of a next flotation body 24, the coupling ring 56 resides substantially against the underside of positioning plate 52. In bow-to-bow orientation when the coupling prongs of both flotation bodies are inserted in their respective coupling rings, the lateral spacing of ring 56 and prong 40 on each side provides some resistance to bending of the two tubes about an articulation axis defined by either set of engaged coupling prongs and rings. This can be avoided if desired by inserting only one of the coupling prongs, the other resting laterally against the outside of its corresponding coupling ring. In that case, the two flotation bodies are free to articulate around the engaged prong and ring.

Preferably, the coupling prong 40, coupling ring 56, positioning plate 52 and mounting plate 44 for each flotation body are an integrally molded unit of flexible material, for example soft PVC. The soft material allows some articulation by deforming with force. In any case, the coupling remains free to articulate around a horizontal axis in the plane of the coupling ring 56 because the shaft portion of prong 40 spaced back from the enlarged diameter knob 72 is somewhat smaller than the internal diameter of ring 56. Knob 72, as shown inserted in a bow coupling 56 on the V-shaped prow end of the flotation body in FIG. 6, is slightly larger than said internal diameter of the ring. Accordingly, the prong 40 must be forced through ring 56 to engage or disengage the coupling. The bow coupling ring 56 is dimensioned similarly to the stern coupling ring 92, shown in FIGS. 7 and 8.

Knob 72 is preferably formed by at least one fin 74 extending radially from the distal end of the coupling prong 40. Preferably a plurality of fins 74 are evenly spaced around the prong. The internal diameter of ring 56 is provided with tapered surfaces engaging corresponding tapered surfaces of the prong in the insertion direction 82 and in the removal direction 84. In order to force prong 40 through ring 56, the fins are resiliently deflected. The deflection of the fins can be facilitated by articulating the flotation bodies around the axis 58 of the prong or ring, tending to cause the fins to lie flat and reducing the diameter of the knob for insertion or removal. This twisting movement is rendered easy by means of handle 54 defined by the proximal portion of the prong 40. Preferably, the insertion taper 76 of the fins 74 is somewhat less steep than the removal taper 78, whereby insertion is easier than removal and it may only be necessary to twist the coupling to effect removal, insertion being accomplished by axial pressure between the prong 40 and the ring 56.

Figure 8:
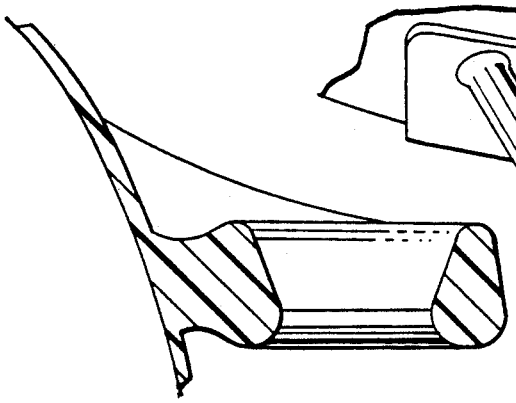
FIG. 8 is a partial section view along lines 8—8 in FIG. 7.

FIGS. 7 and 8 illustrate the stern coupling ring 92. The stern coupling ring is substantially the same configuration as the front coupling ring 56, and includes the tapering surfaces in the insertion direction and removal direction to complement the knob 72 of the prong 40, in the same manner. Stern coupling ring 92 is attached to the flotation body 24 by means of a second mounting plate 94. The stern ring 92 is spaced outwardly from the flotation body 24 in the same manner as bow ring 56 is spaced therefrom. However, the stern ring is spaced by means of struts 90, attached to the rear mounting plate 94. One or more struts can be used for this purpose, the preferred embodiment having a central wider strut and two lateral struts for securely fixing the coupling ring 92 to the mounting plate 94, and thereby to the flotation body 24. The stern coupling ring 92, together with the struts 90 and mounting plate 94 are also formed integrally of molded PVC or like flexible material.

Figure 9:
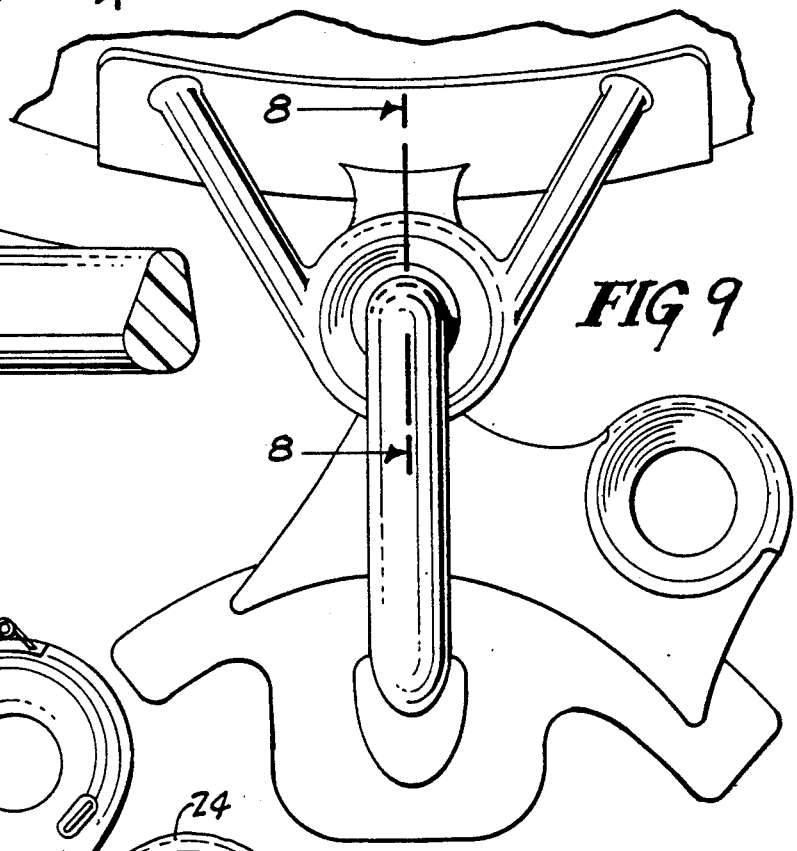
FIG. 9 is a top plan view showing the coupling of bow and stern coupling elements according to the invention.
Figure 10:
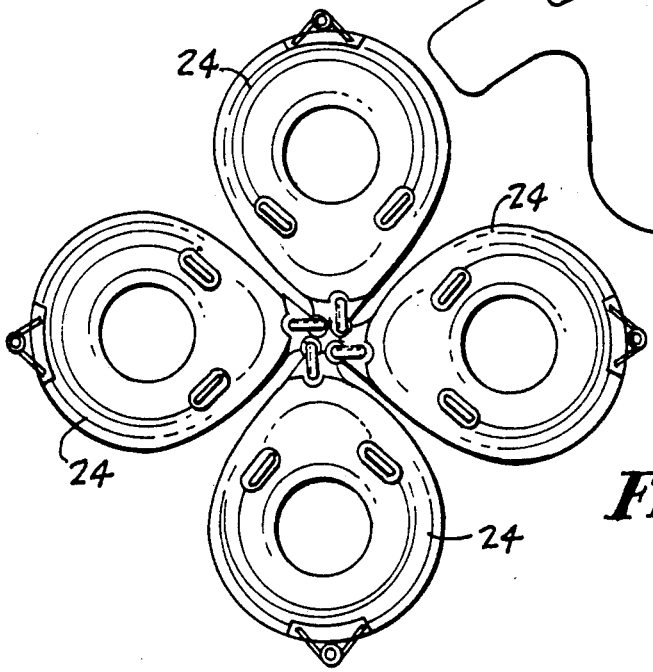
FIG. 10 is a plan view illustrating connection of the flotation apparatus into a two dimensional array.
Figure 11:
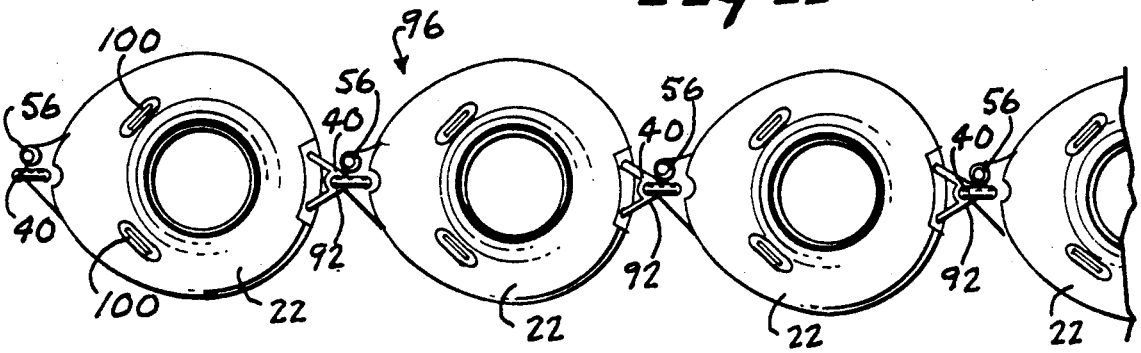
FIG. 11 is a plan view illustrating connection of the flotation apparatus in a single file array.

The flotation body according to the invention can be provided with various arrangements of couplings on the front and rear, or at other locations around the external wall32 of the tube or the like. In the preferred embodiment, the bow coupling has both male and female elements and the stern coupling has only a female element. This arrangement allows the flotation bodies to be connected bow to bow as shown in FIG. 10, wherein the tapering V-shaped bow facilitates an array of four closely spaced flotation bodies. Inasmuch as each of the flotation bodies engages the array at two laterally spaced points, the array is relatively fixed in position. The preferred arrangement also allows the flotation bodies to be connected bow to stern, as shown in FIG. 9, to form a single file array of any length. Such an array is shown in FIG. 11. The bow coupling rings 56 in FIG. 11 remain available for engagement by additional flotation bodies. Should a dual gender coupling be included on both the bow and stern of each of the flotation bodies, the array of FIG. 10 can be extended into a line. Various other configurations are possible and will be apparent in view of the fact that either a coupling ring or a coupling prong, or both, can be similarly mounted at any point around the flotation apparatus.

Figure 12:
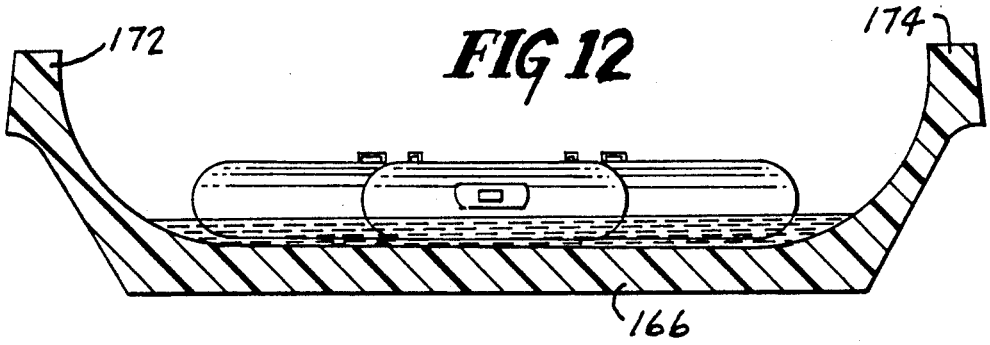
FIG. 12 is a section view through a wide sluice waterslide according to the invention, showing a two dimensional array in position.
Figure 13:
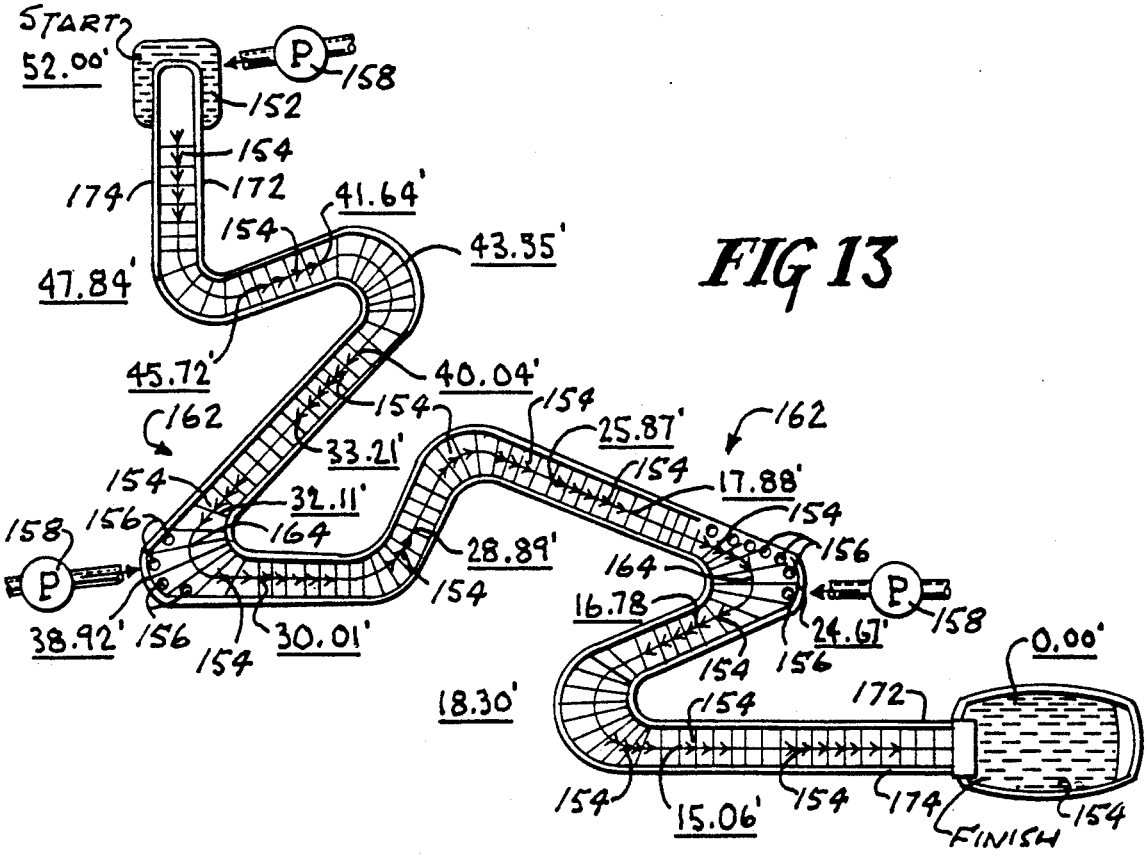
FIG. 13 is a plan view of a full waterslide according to the invention, major vertical displacements being shown by arrows.
Figure 14:
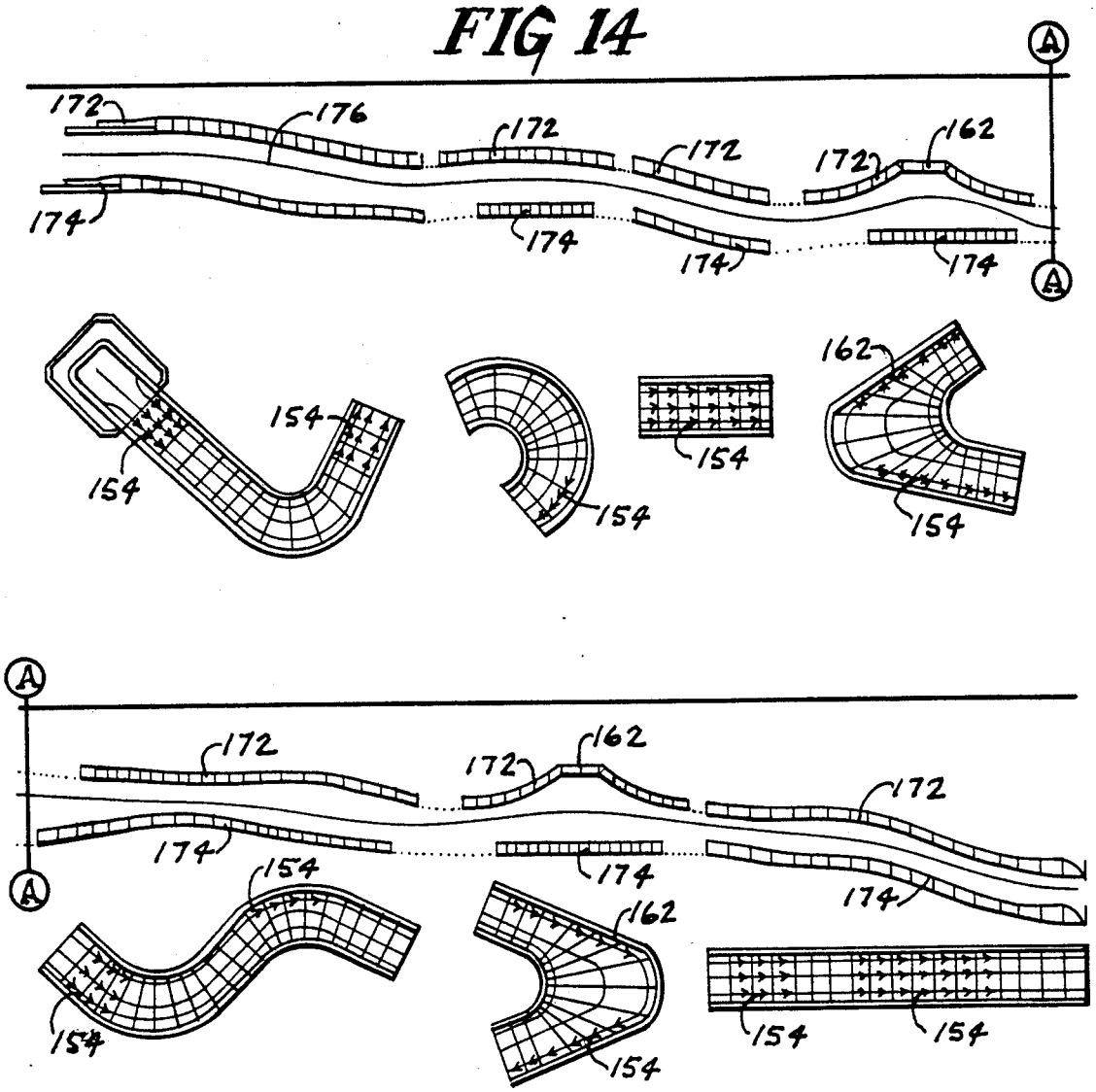
FIG. 14 is a schematic view illustrating the plan view and corresponding left and right side elevations along the waterslide sluice of FIG. 13.

FIGS. 12 through 14 illustrate a waterslide 150 wherein the flotation bodies or arrays of single file or plural file flotation bodies can traverse a sinuous route between a starting pool 152 and a finishing pool 154, along a wide path wherein the riders have the option of moving along a higher or lower path through turns. The path proceeds generally downwards, but the centerline of the path as well as the path which riders can follow also proceeds in part uphill. The low side of each curve follows a downward slope or is horizontal throughout the circuit. In areas where the downward rush of water following a long downward incline is sufficient to carry the water over a hump due to inertia, the path can proceed upwardly along the lower slope as well. However, in the preferred embodiment, the low side of each of the curves is either horizontal or downwardly sloping continuously, while the centerline as well as the upward side of the slope proceeds upward by substantial angles at points slightly downstream of long or steep inclines. This enable a skilled rider to build up a velocity in excess of the water velocity and to plane over the surface of the water and along the banked walls.

Although inertia of the moving water will carry the water up the outside of a curve for a distance, a rider planing over the surface can be carried further up the outside wall, at a curve. Accordingly, to maintain the low friction planing effect of a rider proceeding over a shallow layer of water, the waterslide of the invention includes means to add supplemental flows of water in the area of an uphill or high banked turn. The inclined sections 154 of the track or sluice 150 are depicted by arrows. Two high banked turns 162 are provided in the embodiment of the invention shown in FIG. 13. These turns are arranged such that the centerline of the sluice goes uphill through the turns, and only the lowest portion on the inside of the sluice turns slopes downwardly for drainage. Supplemental water inlets 154 are provided along the sluice at least at the top of the outside wall at these turns. Preferably, a line of supplemental water inlets 156 is provided approaching the high point of the outside wall and passing slightly beyond the high point. The water from the supplemental inlets moves laterally and counter to the direction of the major flow of water through the sluice, the major flow running down the slope leading to the high point of the outside wall and the supplemental flow moving laterally of the main flow and downward on the slope leading to the apex of the turn, as influenced only by gravity. The supplemental water is not carried by inertia from the flow downhill, and simply runs downwardly along the steepest available slope to join the major flow. Accordingly, by providing a plurality of closely spaces supplemental inlets, of a type known in connection with main inlets directed into a major flow for assisting a normal downhill flow, it is possible according to the invention to enable a sluice track to follow high curves, humps, dishes and other configurations wherein the inertia of the rider allows an uphill traverse and water from supplemental inlets provides the necessary reduction of friction to keep the rider moving at full speed. Such inlets are known as geysers or misters.

FIG. 12 illustrates the minimum width of the preferred track, and a typical amount of water retained between the sidewalls 172, 174 defining the sluice. The typical flow in a device of this type may be on the order of 3,000 gallons per minute from the top pool 152 to the bottom pool 154. At each of the high banked turns wherein the centerline of the track goes uphill, supplemental water inlets add about 300 to 500 gallons per minute. The total flow in the sluice thus increases proceeding down the track, to a total of about 4,000 to 5,000 gallons per minute at the bottom pool. Recycling pumps 158 extract water from the finish pool 154 to feed the starting pool 152 and the supplemental inlets at slopes 162. The geysers or misters can be at low volume and high pressure, or higher volume and lower pressure, in either case achieving the desired effect of a low friction water curtain over which the rider skims in a direction transverse to the supplemental flow or counter to the supplemental flow.

The contour of the sluice is shown in FIG. 14, set out linearly. Inasmuch as the left rail 172 (in the direction of flow and traffic) is longer than the right rail 174 around a right hand curve, and vice-versa, the rails appear in different lengths for the respective segments. Nevertheless, by following the centerline 176 running between corresponding hatch lines drawn laterally perpendicular to the direction of flow (also shown in FIG. 13), it is apparent that the centerline, and therefore the traffic proceeding along the track on flotation bodies 22 individually or in lines or arrays, traces a number of uphill traverses.

Figure 15:
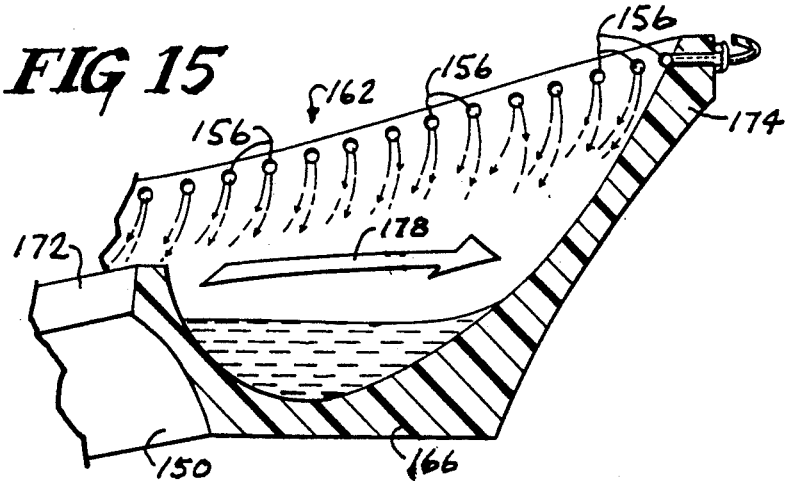
FIG. 15 is a partial section view through a sluice section leading into a high outside curve.

The track material as known in the art can be made of molded fiberglass, for good wear resistance, low friction and light weight. Typically, the waterslide is mounted on a plurality of terraces, often formed in a hillside, to minimize the length of the individual vertical support beams. A wide variety of variations in longitudinal and lateral track slope, track width and water flow are possible. FIG. 15 illustrates a cross section through the sluice at the high point or apex of a high curve 162 downstream of a downhill stretch. Rider trajectory 178 proceeds upwardly on the outside wall, the rider wholly or partly leaving the main flow of water in the sluice and skimming over the water curtain produced by supplemental inlets 156 located on the outside wall 174, at least along the upper edge as shown, and optionally in a two dimensional array on the outside wall. These inlets can be provided all along the top edge of the high outside wall to support the rider until he or she returns to the major flow on the downstream side of the high curve.

The invention as disclosed herein is a flotation apparatus 22, with a buoyant body 24 having a central aperture 26 in which a rider can sit, the aperture being encompassed by substantially tubular buoyant shape 28 defining an outer wall 32 around the buoyant body 24. A coupling therefor has a coupling prong 40 with a proximal end 42 attached to a first mounting plate 44 mounted on the outer wall 32, the coupling prong 40 having a proximal section 46 extending outwardly from the buoyant body 24 and a distal section 48 turned perpendicular to the proximal section 46, the distal section 48 being disposed at a space from the outer wall 32. A positioning plate 52 is attached to the mounting plate 44 and extends outwardly from the buoyant body 24. The positioning plate 52 is attached to the distal section 48 of the coupling prong 40 at a space from a distal end of the distal section, the proximal section 46 of the coupling prong defining a manually engageable handle 54. A coupling ring 56 is attached to the positioning plate 52, the coupling ring 56 defining an axis substantially parallel to an axis 58 of the coupling prong 40 and being spaced laterally from the coupling prong 40, the coupling ring 56 having an internal diameter 62 substantially corresponding to an external diameter of the coupling prong 40.

The buoyant body 24 can be inflatable, and the coupling prong 40, the first mounting plate 44 and the positioning plate 52 are preferably formed as an integral unit of flexible material, for example integrally molded flexible polyvinyl chloride (PVC), which is adhesively attached or welded to a surface 32 of the flotation body 24.

In order to better lock the coupling when engaged, the coupling prong 40 has means 72 defining an increase in diameter adjacent the distal end of the distal section 48 of the coupling prong 40, said increase in diameter exceeding the internal diameter 62 of the coupling ring 56. At least one of the coupling ring 56 and the means 72 defining the increase in diameter are resiliently deformable to allow insertion and removal of the coupling prong 40 from a respective coupling ring 56, 92. The increase in diameter 72 preferably is defined by at least one fin 74 protruding radially of the distal section of the coupling prong 40, the fin 74 being resiliently deformable by contact with the coupling ring 56, 92. Preferably, a plurality of fins 74 protrude radially of the distal section 48 of the coupling prong 40 to form a locking knob 72. The coupling ring 56, 92 and the fins 74 forming the locking knob 72 have substantially complementary conical surfaces 76, 78, 62 facing one another in at least one of an insertion direction 82 and a removal direction 84, preferably in both directions, and the conical surfaces can be arranged such that the conical surfaces 78 in the removal direction have a steeper slope than the conical surfaces 76 in the insertion direction, whereby the coupling ring 56, 92 and the coupling prong 40 are more easily inserted than removed.

The buoyant body 24 can be generally tubular, with a protruding or tapered portion 86 in the outer wall 32 defining a substantially V-shaped bow or prow. A rounded portion 88 in the outer wall 32 opposite the V-shaped bow 86 defines a stern, the integral unit being mounted on the bow. A second coupling ring 92 is attached to a second coupling plate 94, the second coupling plate 94 being attached to the buoyant body 24 at the stern, whereby a plurality of the buoyant bodies are alternatively attachable bow to bow and stern to bow, defining arrays or lines of the buoyant bodies. The second coupling ring 92 can be attached to the second coupling plate 94 by at least one positioning strut 90 spacing the second coupling ring 92 outwardly from the outer wall 32 of the buoyant body 24. Preferably, the second coupling ring 92 is attached to the second coupling plate 94 by a plurality of positioning struts 90 spacing the second coupling ring 92 outwardly from the outer wall 32 of the buoyant body 24, the positioning struts 90 extending at least partly laterally from the second coupling ring 92 to the second mounting plate 94.

The invention also concerns the coupling per se. The coupling has a mounting plate 44 to be fixed to a wall 32 of the flotation body 24 or the like. A coupling prong 40 thereof has a proximal end attached to the mounting plate 44, the coupling prong 40 having a proximal section 46 extending outwardly from the wall 32 of the flotation body 24 or the like and a distal section 48 turned vertically from the proximal section 46, the distal section 48 being disposed at a space from the mounting plate 44. A coupling ring 56 is attached to the mounting plate 44, the coupling ring 56 having an opening 62 dimensioned to complement the coupling prong 40 and defining an axis parallel to an axis 58 of the coupling prong 40, the coupling ring 56 being spaced laterally from the coupling prong 40.

A positioning plate 52 preferably extends between the mounting plate 44 and the coupling prong 40. The mounting plate 44, the coupling prong 40, the coupling ring 56 and the positioning plate 52 preferably are formed as an integral unit of flexible material, for example integrally molded flexible polyvinyl chloride (PVC), the mounting plate 44 being curved to conform to the flotation body 24 and being attachable to a surface of the flotation body by one of adhesive and welding.

The coupling includes means 72 defining an increase in diameter adjacent the distal end of the distal section 48 of the coupling prong 40, said increase in diameter exceeding the internal diameter 62 of the coupling ring 56. At least one of the coupling ring 56 and the means 72 defining the increase in diameter is resiliently deformable to allow insertion and removal of the coupling prong 40 from a respective coupling ring 56, 92. This increase in diameter 72 can be defined by at least one fin 74 protruding radially of the distal section 48 of the coupling prong 40, the fin 74 being resiliently deformable by contact with the coupling ring 56, 92. Preferably, a plurality of such fins 74 protrude radially of the distal section 48 of the coupling prong 40 to form a locking knob 72. The coupling ring 56 and the fins 74 forming the locking knob 72 can have substantially complementary conical surfaces 76, 78, 62 facing one another in at least one of an insertion direction 82 and a removal direction 84, preferably in both directions, and preferably arranged such that the conical surfaces 78 in the removal direction 84 have a steeper slope than the conical surfaces 76 in the insertion direction 82, whereby the coupling ring 56, 92 and the coupling prong 40 are more easily inserted than removed.

The preferred flotation apparatus 22 employing the coupling has a buoyant flotation body 24 with outer sidewalls 32 on two opposite sides 86, 88, one of the outer sidewalls 86 defining a substantially V-shaped bow and an opposite one of the outer sidewalls 88 defining a stern. A coupling therefor has a coupling prong 40 having a proximal end 42 attached to the V-shaped bow 86 of the flotation body 24, the coupling prong 40 having a proximal section 46 extending forward from the bow 86 and a distal section 48 turned vertically downwardly from the proximal section 46, the distal section 48 being disposed at a space from the first outer sidewall 32 such that the proximal section 46 defines a handgrip 54. A first coupling ring 56 is fixed along the bow 86 and spaced laterally of the coupling prong 40, the coupling ring 56 having an opening dimensioned to complement the coupling prong 40 and defining a vertical axis, whereby the flotation apparatus is attachable to at least one other said flotation apparatus in bow-to-bow relation and in arrays of more than two said flotation apparatus. A second coupling ring 92 is attached to the stern 88 of the flotation body 24, the second coupling ring 92 defining an axis substantially parallel to the axis of the first coupling ring 56, whereby the flotation apparatus is attachable to another said flotation apparatus in a line.

The waterslide of the invention includes an elongated sluice 150 having a sinuous path including curves, the path proceeding generally downwards over its length, the sluice being wide enough to accommodate at least one of flotation apparatus 24 and riders. Means 152 supply a flow of water to a top of the sluice. At least one curve is provided along the path of the sluice, downstream along a flow path from a downslope 154, the curve having an inside wall 172 or 174 proceeding at one of horizontal and a downward direction, and an outside wall 174 or 172 proceeding upwardly, whereby a centerline 176 between the inside wall 172 or 174 and the outside wall 174 or 172 proceeds upwardly around said curve. A supplementary means 158 for supplies a supplementary flow of water to the sluice at a point 156 below a top of said outside wall, whereby said one of the flotation apparatus and the riders follows a path proceeding upwardly around the curve on a layer of water produced by the supplementary flow of water.

The flow of water can proceed to a catch pool 160 and the supplementary flow of water can be recycled from the catch pool 160 by at least one pump 158. The means for supplying the supplementary flow of water preferably includes a plurality of openings 156 along the top of the outside wall 172 or 174, the supplementary flow of water flowing downwardly by gravity at least partly in a direction opposite a path of the one of the floatation apparatus and the riders.

The invention having been disclosed, a number of variations and additional embodiments within the scope of the invention will now become apparent to persons skilled in the art. Reference should be made to the appended claims rather than the foregoing specification to assess the scope of exclusive rights claimed.

I claim:

1. A flotation apparatus, comprising:

a buoyant body having a central aperture in which a rider can sit, the aperture being encompassed by a substantially tubular buoyant shape defining an outer wall around the buoyant body;

a coupling prong having a proximal end attached to a first mounting plate mounted on the outer wall, the coupling prong having a proximal section extending outwardly from the buoyant body and a distal section turned perpendicular to the proximal section, the distal section being spaced from the outer wall;

a positioning plate attached to the mounting plate and extending outwardly from the buoyant body and being attached to the distal section of the coupling prong at a space from a distal end of the distal section, the proximal section of the coupling prong defining a manually engageable handle;

a coupling ring attached to the positioning plate, the coupling ring defining an axis substantially parallel to an axis of the coupling prong and being spaced laterally from the coupling prong, the coupling ring having an internal diameter substantially corresponding to an external diameter of the coupling prong.

2. The flotation apparatus of claim 1, wherein the buoyant body is inflatable, and the coupling prong, the first coupling plate and the positioning plate are formed as an integral unit of flexible material.

3. THe floatation apparatus of claim 2, wherein the integral unit is integrally molded flexible polyvinyl chloride (PVC), attached to a surface of the flotation body.

4. The flotation apparatus of claim 2, further comprising means defining an increase in diameter adjacent a distal end of the distal section of the coupling prong, said increase in diameter exceeding the internal diameter of the coupling ring, and at least one of the coupling ring and the means defining the increase in diameter being resiliently deformable to allow insertion and removal of the coupling prong from a respective said coupling ring attached to a second said flotation apparatus.

5. The flotation apparatus of claim 4, wherein the increase in diameter is defined by at least one fin protruding radially of the distal section of the coupling prong, the fin being resiliently deformable by contact with the respective said coupling ring of the second said flotation apparatus.

6. The flotation apparatus of claim 5, wherein the same defining an increase in diameter comprises a plurality of fins protruding radially of the distal section of the coupling prong to form a locking knob.

7. The flotation apparatus of claim 6, wherein the respective said coupling ring of the second flotation apparatus and the fins forming the locking knob have substantially complementary conical surface facing one another in at least one of an insertion direction and a removal direction.

8. The floatation apparatus of claim 7, wherein the fins forming the locking knob have substantially complementary conical surfaces facing one another in both the insertion direction and the removal direction, and wherein the conical surfaces in the removal direction have a steeper slope than the conical surfaces in the insertion direction, whereby the respective said coupling ring of the second flotation apparatus and the coupling prong are more easily inserted than removed.

9. The flotation apparatus of claim 2, wherein the buoyant body is generally tubular and has a protruding portion in the outer wall defining a substantially V-shaped bow and a rounded portion in the outer wall opposite the V-shaped bow defining a stern, the integral unit being mounted on the bow.

10. The flotation apparatus of claim 9, further comprising a second coupling ring attached to a second coupling plate, the second coupling plate being attached to the buoyant body at the stern, whereby a plurality of the buoyant bodies are alternatively attachable bow to bow and stern to bow, defining arrays and lines of the buoyant bodies.

11. The flotation apparatus of claim 10, wherein the second coupling ring is attached to the second coupling plate by at least one positioning strut spacing the second coupling ring outwardly from the outer wall of the buoyant body.

12. The flotation apparatus of claim 11, wherein the second coupling ring is attached to the second coupling plate by a plurality of positioning struts spacing the second coupling ring outwardly from the outer wall of the buoyant body, the positioning struts extending at least partly laterally from the second coupling ring to the second mounting plate.

13. A coupling for a flotation body, comprising:

a mounting plate to be fixed to a wall of the flotation body;

a coupling prong having a proximal end attached to the mounting plate, the coupling prong having a proximal section extended outwardly from the wall of the flotation body and a distal section turned vertically from the proximal section, the distal section being spaced from the mounting plate; and, a coupling ring attached to said mounting plate, the coupling ring having an opening dimensioned to complement a respective said coupling prong attached to a second said mounting plate and defining an axis parallel to an axis of the coupling prong, the coupling ring being spaced laterally from the coupling prong.

14. A coupling for a flotation body, comprising:

a mounting plate to be fixed to a wall of the flotation body;

a coupling prong having a proximal end attached to the mounting plate, the coupling prong having a proximal section extended outwardly from the wall of the flotation body and a distal section turned vertically from the proximal section, the distal section being spaced from the mounting plate;

a coupling ring attached to the mounting plate, the coupling ring having an opening dimensioned to complement the coupling prong and defining an axis parallel to an axis of the coupling prong, the coupling ring being spaced laterally from the coupling prong; and, a positioning plate extending between the mounting plate and the coupling prong, and wherein the mounting plate, the coupling prong, the coupling plate and the positioning plate are formed as an integral unit of flexible material.

15. The coupling of claim 14, wherein the integral unit is integrally molded flexible polyvinyl chloride (PVC), the mounting plate being curved to conform to the flotation body and being attachable to a surface of the flotation body by one of adhesive and welding.

16. The coupling of claim 14, further comprising means defining an increase in diameter adjacent a distal end of the distal section of the coupling prong, said increase in diameter exceeding the internal diameter of the coupling ring, and at least one of the coupling ring and the means defining the increase in diameter being resiliently deformable to allow insertion and removal of the coupling prong from a respective said coupling ring attached to a second said flotation apparatus.

17. The coupling of claim 16, wherein the increase in diameter is defined by at least one fin protruding radially of the distal section of the coupling prong, the fin being resiliently deformable by contact with the respective said coupling ring of the second said flotation apparatus.

18. The coupling of claim 17, wherein the means defining an increase in diameter comprises a plurality of fins protruding radially of the distal section of the coupling prong to form a locking knob.

19. The coupling of claim 18, wherein the respective said coupling ring of the second flotation apparatus and the fins forming the locking knob have substantially complementary conical surfaces facing one another in at least one of an insertion and a removal direction.

20. The coupling of claim 19, wherein the fins forming the locking knob have substantially complementary conical surfaces facing one another in both the insertion direction and the removal direction, and wherein the conical surfaces in the removal direction have a steeper slope than the conical surfaces in the insertion direction, whereby the respective said coupling ring of the second said flotation apparatus and the coupling prong are more easily inserted than removed.

21. A flotation apparatus, comprising:

a buoyant flotation body having outer sidewalls on two opposite sides, one of the outer sidewalls defining a substantially V-shaped bow and an opposite one of the outer sidewalls defining a stern;

a coupling prong having a proximal end attached to the V-shaped bow of the flotation body, the coupling prong having a proximal section extending forward from the bow and a distal section turned vertically downwardly from the proximal section, the distal section being spaced from the first outer sidewall such that the proximal section defines a handgrip;

a first coupling ring fixed along the bow and spaced laterally of the coupling prong, the coupling ring having an opening dimensioned to complement the coupling prong and defining a vertical axis, whereby the flotation apparatus is attachable to at least one other said flotation apparatus in bow-to-bow relation and in arrays of more than two said flotation apparatus; and, a second coupling ring attached to the stern of the flotation body, the second coupling ring defining an axis substantially parallel to the axis of the first coupling ring, whereby the flotation apparatus is attachable to another said flotation apparatus in a line.

22. The flotation apparatus of claim 21, wherein the buoyant body is inflatable and substantially tubular, and the coupling prong, the first coupling plate and the positioning plate are formed as an integral unit of flexible material.

23. The flotation apparatus of claim 21, further comprising means defining an increase in diameter adjacent a distal end of the distal section of the coupling prong, said increase in diameter exceeding the internal diameter if the coupling rings, and at least one of the coupling rings and the means defining the increase in diameter being resiliently deformable to allow insertion and removal of the coupling prong from a respective said coupling ring attached to a second said flotation apparatus.

24. The floatation apparatus of claim 23, wherein the increase in diameter is defined by at least one fin protruding radially of the distal section of the coupling prong and forming a locking knob, the fin being resiliently deformable by contact with one of the respective said coupling rings of the second flotation apparatus.

25. The flotation apparatus of claim 24, wherein the respective said coupling rings of the second flotation apparatus and the fin forming the locking knob have substantially complementary conical surfaces facing one another in at least one of an insertion direction and a removal direction.

26. The flotation apparatus of claim 25, wherein the fin forming the locking knob and the respective said coupling rings of the second flotation apparatus have substantially complementary conical surfaces facing one another in both the insertion direction and the removal direction, and wherein the conical surfaces in the removal direction have a steeper slope than the conical surfaces in the insertion direction, whereby the respective said coupling rings of the second flotation apparatus and the coupling prong are more easily inserted than removed.

* * * * *